United States Patent [19]

Wilhelm

[11] 3,962,842

[45] June 15, 1976

[54] MORTARLESS INTERLOCKING BLOCKS

[76] Inventor: William D. Wilhelm, 533 San Juan, St. Charles, Mo. 63301

[22] Filed: May 30, 1975

[21] Appl. No.: 582,160

[52] U.S. Cl. ..... 52/436; 52/286; 52/589

[51] Int. Cl.[2] ..... E04B 2/20; E04C 1/12

[58] Field of Search ..... 52/286, 436, 585, 589, 52/593; 46/25, 26

[56] References Cited

UNITED STATES PATENTS

| | | | |
|---|---|---|---|
| 3,116,570 | 1/1964 | Torricelli | 52/593 X |
| 3,256,657 | 6/1966 | Phipps | 52/227 |
| 3,534,518 | 10/1970 | Zagray | 52/286 |

FOREIGN PATENTS OR APPLICATIONS

| | | | |
|---|---|---|---|
| 136,318 | 2/1950 | Australia | 52/286 |
| 504,811 | 7/1939 | United Kingdom | 52/436 |

*Primary Examiner*—J. Karl Bell
*Attorney, Agent, or Firm*—Gravely, Lieder & Woodruff

[57] ABSTRACT

Mortarless interlocking blocks for making a wall assembly composed of masonry blocks laid up in multiple courses and consisting of stretcher blocks making up longitudinal walls which converge at the corners in corner blocks which are formed as right hand and left hand corner blocks. The blocks in the wall assembly are made with a unique arrangement of mating ribs and grooves which makes the laying of the blocks easy and yields a cooperating group of blocks which can carry loads and which makes the creation of a wall very simple and fast as no mortar is needed and the blocks are self aligning and stable.

11 Claims, 11 Drawing Figures

FIG. 2
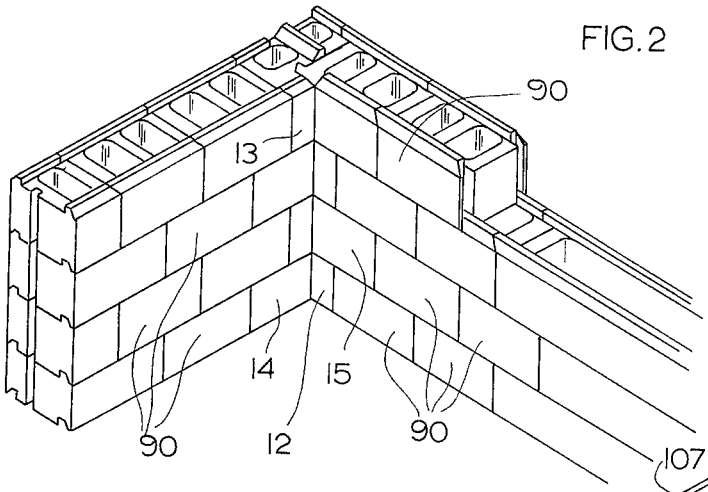
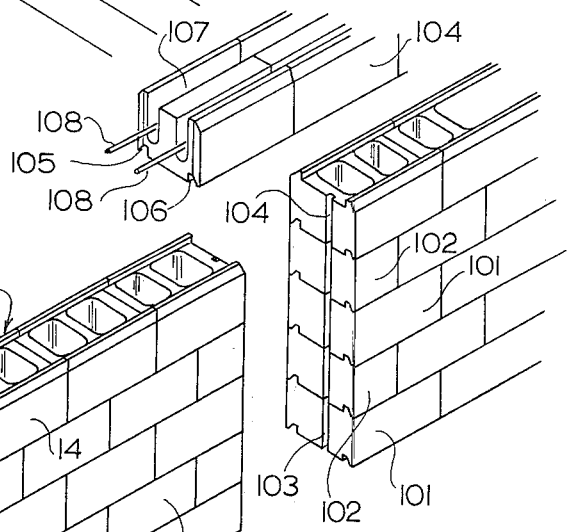
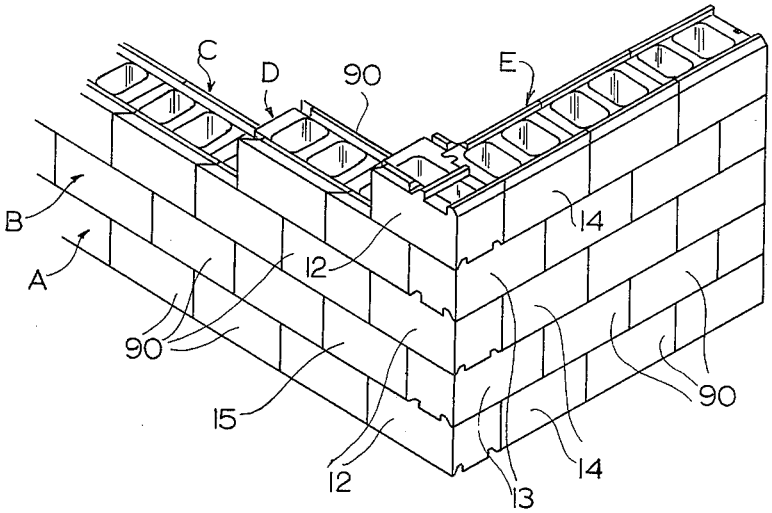
FIG. 1
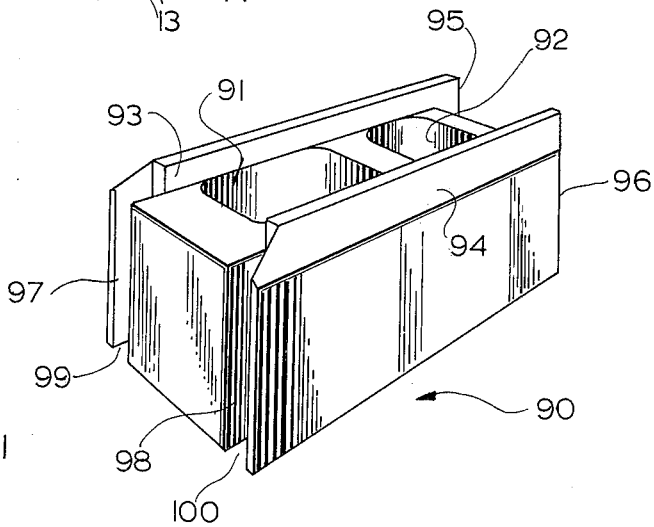
FIG. 11

MORTARLESS INTERLOCKING BLOCKS

BACKGROUND OF THE INVENTION

This invention relates to mortarless interlocking blocks for use in masonry block wall assemblies. The masonry blocks incorporated in a mortarless wall layup are formed with cooperating projecting ribs and grooves to provide the interlocking means and to render the construction of the finished wall rapid.

An important object of this invention is directed to the improvement of providing one-piece corner blocks with unique and simple right hand and left hand configurations which will permit the simple and rapid construction of 12 inch thick walls using modular sized stretcher blocks.

It is an important object of the present invention to provide masonry blocks which include the improved corner blocks and compatible stretcher blocks so as to provide the building trades with inexpensive and positive interlocking mortarless blocks having exterior exposed surfaces conforming to the modular standards, but with the attributes that the blocks may be laid up rapidly and maintain a running bond around corners.

A preferred embodiment for a mortarless masonry building block wall assembly is composed of interlocking courses of stretcher blocks converging at a corner from two directions into cooperating corner blocks in each course to join said stretcher block: and wherein each of the corner blocks is formed with a generally elongated and rectangularly shaped body having elongated and generally parallel top and bottom surfaces, elongated and generally parallel exterior and interior faces, and opposite end faces generally perpendicular to said top and bottom surfaces and exterior and interior faces; wherein the bottom surface has a pair of grooves therein and the top surface has a plurality of projecting ribs, with one end face having a dimension approximately one-half the dimension of the elongated exterior face; and wherein the body has an extension disposed on its interior face adjacent one end face and projecting therefrom to a dimension approximately one-half the dimension of the other end face, and the projecting extension is formed with an upper surface having a projecting rib and a lower surface having a groove therein.

In order to be certain of obtaining blocks that will interlock in all directions, the embodiment hereof is characterized by the corner blocks having at least three grooves in the bottom surface which interlock with at least four ribs in the underlying blocks, and each of the corner blocks having at least five grooves and six ribs arranged to interlock with six different blocks in a corner lay up.

BRIEF DESCRIPTION OF THE DRAWINGS

The masonry block wall assembly of this invention is shown in the accompanying drawings, wherein:

FIG. 1 is a perspective view from the exterior of a masonry block wall assembly showing stretcher blocks converging to a corner made up of corner blocks according to this invention;

FIG. 2 is a perspective view as seen from the interior of the masonry block wall assembly shown in FIG. 1;

FIG. 11 is a perspective view of a regular stretcher block.

DETAILED DESCRIPTION OF THE EMBODIMENTS

Figure 3:
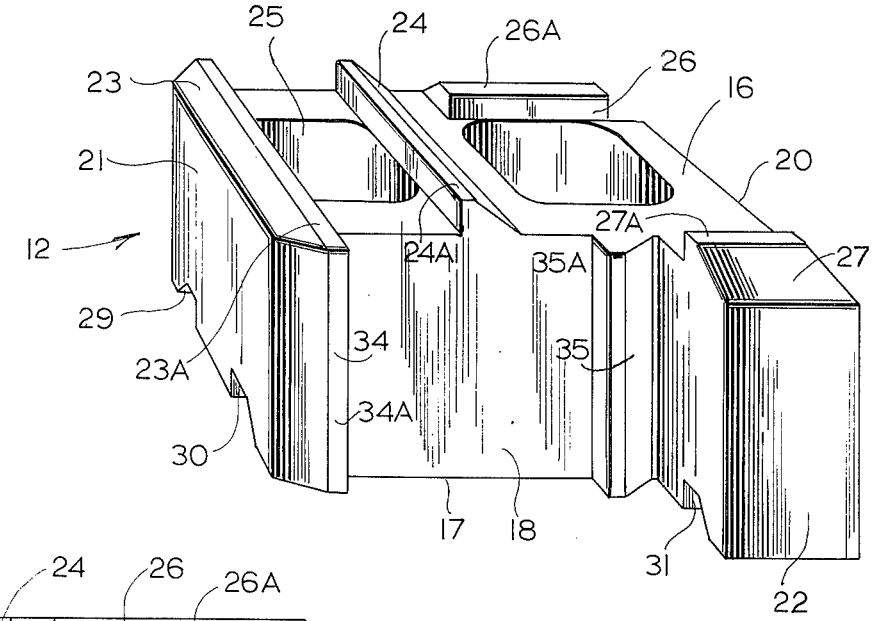
FIG. 3 is a perspective view of a left hand corner block showing the important features of its configuration.

The several blocks to be described presently are shaped ans sized to produce a block wall lay up of the character seen from the exterior and interior respectively in FIGS. 1 and 2. Stretcher blocks are laid up in a running bond and are directed to converge at a corner made up of left hand corner blocks 12 (FIG. 3) and right hand corner blocks 13 (FIG. 7) such that the corner blocks are compatible with the usual running bond and carry the running bond through the corner. The modular dimensions for masonry blocks may be 8 inches × 16 inches in which the 16 inches length and 8 inches height is exposed to the exterior surface of the wall layup, while the width of stretcher blocks establishes the wall thickness. The blocks of the present invention are disclosed with exposed surfaces which conform to the foregoing 8 inches × 16 inches modular dimensions for the length and height of the blocks, but the blocks have a width for carrying loads usually imposed on exterior walls, as distinguished from interior wall that are generally less heavily loaded or non-load bearing. In order to achieve a wall with interlocking masonry blocks otherwise conforming to the usual modular dimensions it is important to provide right hand and left hand corner blocks having the particular configurations to be described hereinafter.

As seen, the assembly is made up of stretcher blocks which converge from two sides into a corner having corner blocks 12 and 13. As will appear presently, certain of the stretcher blocks which abut corner blocks 12 are seen at 14, and certain other stretcher blocks 15 abut corner blocks 13. The important blocks are those located at the corners for the reason that in erecting a 12 inches thick wall with blocks in running bond courses, and duplicating the standard modular block dimension of 16 inches length and 8 inches height, a major portion of the body of the corner blocks is formed with an 8 inches width to maintain the running bond overlap but it must also have a portion compatible with the width of the stretcher blocks, such as blocks 14 and 15.

Figure 4:
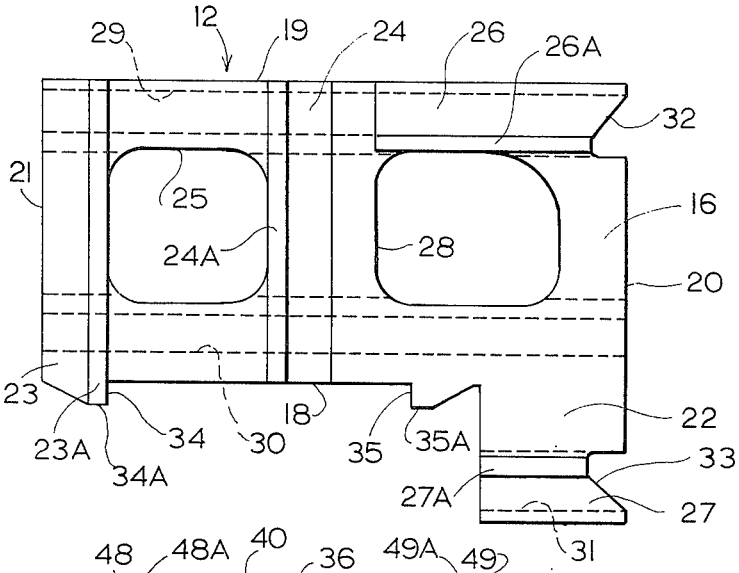
FIG. 4 is a plan view of the left hand corner block of FIG. 3.

Looking at FIGS. 3 and 4, it can be seen that the corner block 12 is formed with a cored body of generally rectangular shape having top and bottom surfaces 16 and 17, interior and exterior faces 18 and 19, and opposed end faces 20 and 21. These surfaces and faces are generally perpendicular to each other, and in the example shown the elongated exterior face 19 is 16 inches long and 8 inches high. The end face 21 is 8 inches high and wide, while the end face 20 is made to be 8 inches high and 12 inches wide by the formation of a body extension 22 projecting outwardly from the interior face 18. Since the blocks are intended to be used in an interlocking mortarless wall assembly, the top surface of block 12 is formed with a pair of spaced projecting ribs 23 and 24, each having a flat facet 23A and 24A topping off a triangular shape having a flat vertical wall and a sloping wall, as clearly shown. These ribs 23 and 24 are directed across the width of the body beginning adjacent end face 21 and separated by the cored out through opening 25. There is a second pair of ribs 26 and 27, each having a flat facet 26A and 27A and a shape as noted above. The rib 26 is adjacent the longitudinal face 19 and the cored out opening 28, while rib 27 is on the top of the body extension 22, and ribs 26 and 27 are parallel, while being perpendicular to the first described ribs 23 and 24.

In making up a mortarless wall assembly with a corner block 12, the bottom surface 17 is formed with longitudinally extending and parallel grooves 29 and 30, and the body extension is formed with a bottom groove 31 which is parallel to grooves 29 and 30. In addition to the grooves in the bottom of the block 12 there are grooves 32 and 33, one in the end face 20 and the other in the body extension 22. Also, the interior face 18 is formed with projecting ribs 34 and 35, and each rib is formed with a flat facet 34A and 35A. The rib 34 is aligned with top rib 23, and the end grooves 32 and 33 are aligned with bottom grooves 29 and 31. The grooves are also formed with a facet which matches the facets noted for the ribs so that when ribs and grooves are mated the facets will match and carry vertical loads.

Figure 5:
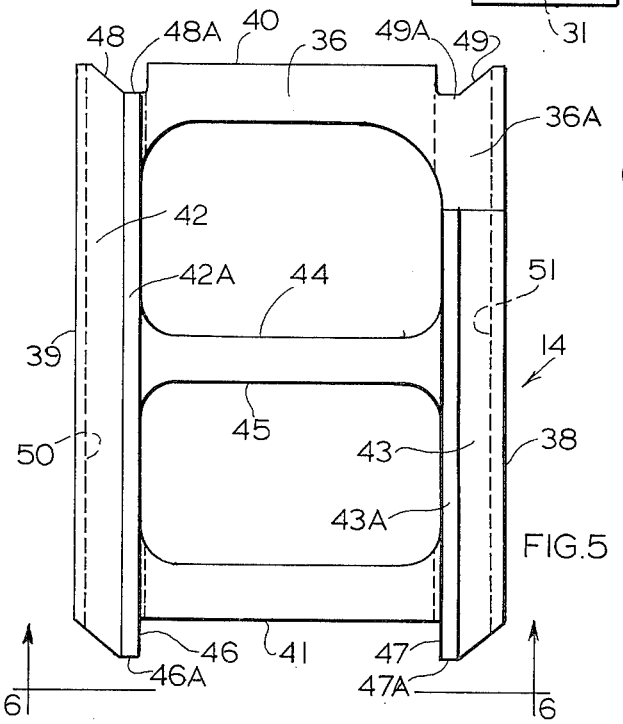
FIG. 5 is a plan view of a stretcher block which is adapted to cooperate directly with the corner block of FIG. 4.
Figure 6:
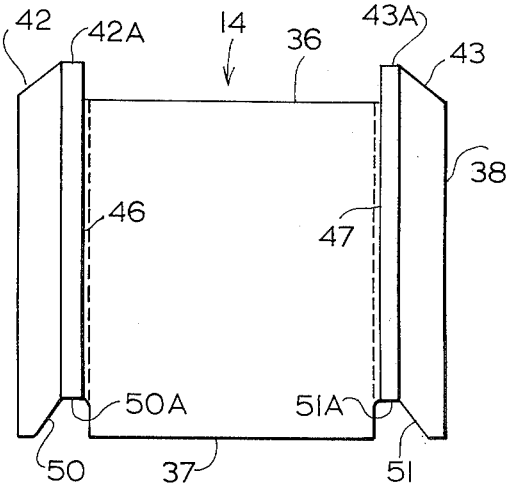
FIG. 6 is an end elevation taken at line 6—6 in FIG. 5.

The stretcher block 14 of FIGS. 5 and 6 is adapted to abut the corner block 12 of FIG. 4 by being placed in abutment against the interior face 18. This block 14 has a generally rectangular body shape with top and bottom surfaces 36 and 37, interior and exterior faces 38 and 39, and end faces 40 and 41. The top surface 36 is formed with spaced parallel and longitudinal ribs 42 and 43 between faces 38 and 39 and cored out openings 44 and 45. These ribs 42 and 43 are aligned with ribs 46 and 47 on the end face 41, while the opposite end face 40 of this block 14 has grooves 48 and 49 which are aligned with top ribs 42 and 43, as well as with longitudinally directed parallel bottom grooves 50 and 51. This stretcher block 14 has a special feature in which the top rib 43 adjacent the interior face 38 is shortened or cut off to form a short length flat 36A so the rib 43 will be clear of the end of the short top rib 27 on the body extension 22 for block 12. As noted before, the respective ribs on block 14 have load bearing facets 42A, 43A, 46A and 47A; and the grooves have matching facets 48A, 49A, 50A and 51A.

Figure 7:
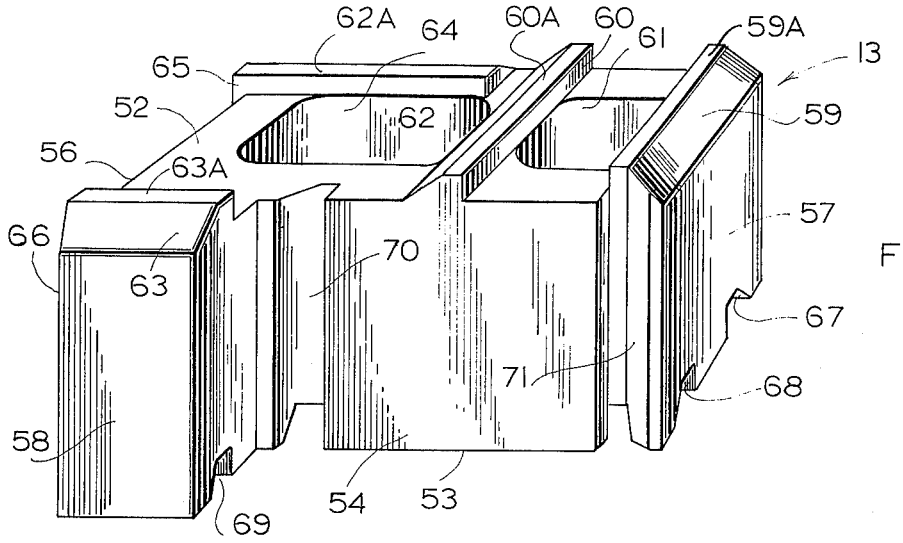
FIG. 7 is a perspective view of a right hand corner block showing the important features of its configuration.
Figure 8:
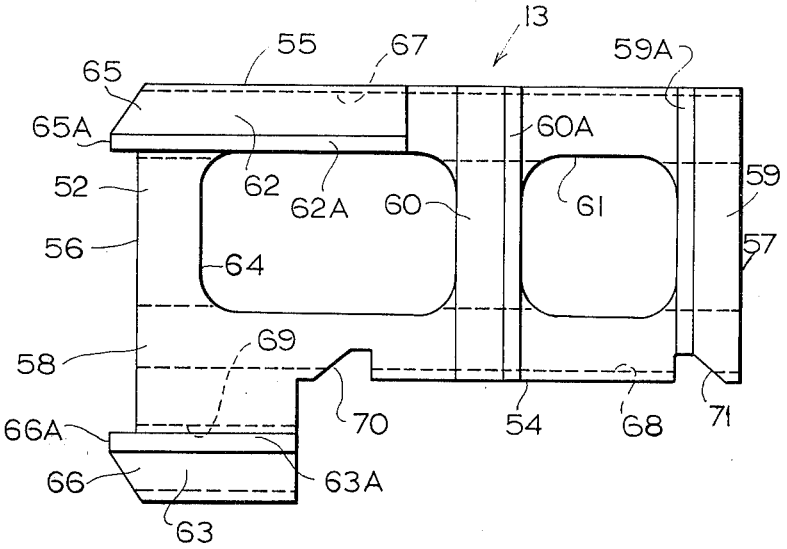
FIG. 8 is a plan view of the right hand corner block of FIG. 7.

Alternate courses of blocks in the wall of FIGS. 1 and 2 have corner blocks 13 seen in detail in FIGS. 7 and 8. This block is formed with a cored body of generally rectangular shape having top and bottom surfaces 52 and 53, interior and exterior faces 54 and 55, and opposed end faces 56 and 57. These surfaces and faces are generally perpendicular to each other, and the elongated exterior face 55 maay be 16 inches long and 8 inches high to correspond to modular standards. In such event, the end face 57 is 8 inches high and wide, while the end face 56 is made to be 12 inches wide by the formtion of a body extension 58 projecting outwardly from the interior face 54. Block 13 is formed on its top surface 52 with two pairs of ribs, one parallel pair 59 and 60 being directed across the block width on each side of the cored opening 61, and the other parallel pair of ribs 62 and 63 being perpendicular to the first rib pair and spaced across the 12 inches wide portion of the block with rib 63 being located on the body extension 58 and rib 62 being spaced therefrom across the cored opening 64. Ribs 65 and 66 on the end face 56 of the block 13 align with the top ribs 62 and 63. In addition to the several ribs, block 13 is formed in its bottom surface with a pair of longitudinally extending and parallel grooves 67 and 68, and the body extension 58 has a bottom groove 69 that is parallel to the other grooves 67 and 68. Also, the interior face 54 is formed with grooves 70 and 71. As before pointed out the ribs 59, 60, 62, 63, 65 and 66 are formed with load bearing facets 59A, 60A, 62A, 63A, 65A and 66A. Similarly the grooves have matching facets that are shown but not enumerated specifically.

Figure 10:
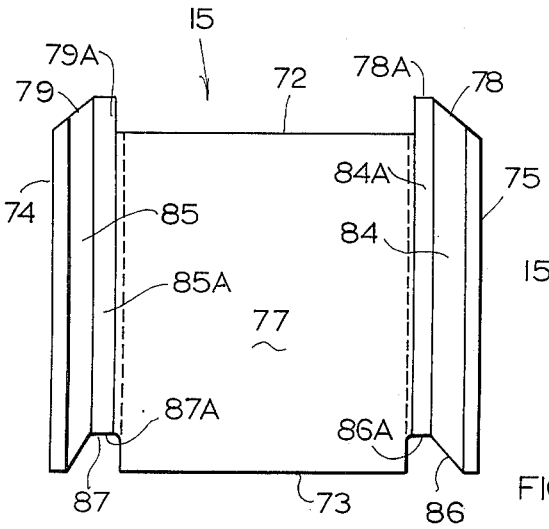
FIG. 10 is an elevation view taken at line 10—10 in FIG. 9.
Figure 9:
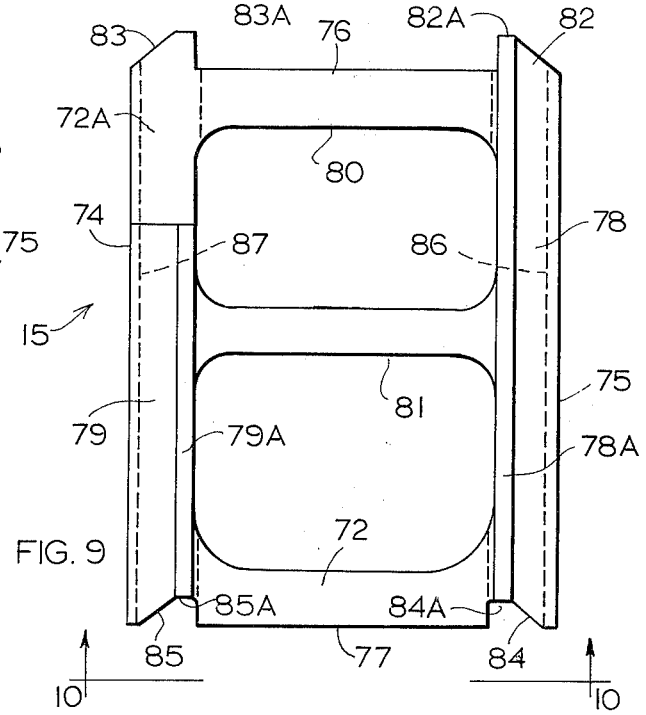
FIG. 9 is a plan view of a stretcher block adapted to cooperate with the corner block of FIG. 8.

In FIGS. 9 and 10 there is seen a stretcher block 15 adapted to cooperate with the corner block 13 of FIG. 8 by being placed with one end face in abutment with the interior face 54 thereof. Block 15 has a generally rectangular body with top and bottom surfaces 72 and 73, interior and exterior faces 74 and 75, and opposite end faces 76 and 77. Top surface 72 has spaced parallel ribs 78 and 79 on each side of cored openings 80 and 81. These ribs are aligned with ribs 82 and 83 on end face 76 and are also aligned with grooves 84 and 85 on the opposite end 77. The bottom surface 73 is formed with parallel and longitudinal grooves 86 and 87 which align with end face grooves 84 and 85 and with end face ribs 82 and 83. The top rib 79 of block 15 is shorter than rib 78 to form a flat 72A which clears the rib 63 on body extension of block 13 so the groove in the next overlying block will mate properly. Furthermore, the ribs 78, 79, 82 and 83 are formed with facets 78A, 79A, 82A and 83A, and the grooves 84, 85, 86 and 87 have matching facets 84A, 85A, 86A and 87A.

The wall assembly of FIG. 1 includes regular stretcher blocks 90 of the character seen in FIG. 11. Block 90 has a rectangular body with cored openings 91 and 92. The top surface is provided with parallel and longitudinal ribs 93 and 94 which are aligned with ribs 95 and 96 on one end face, and with grooves 97 and 98 on the opposite end face. The bottom surface of the block 90 is formed with parallel and longitudinal grooves 99 and 100 which align with end grooves 97 and 98. The respective ribs and grooves on block 90 have facets of the character before noted for the other blocks, and the same are shown but not enumerated specifically. It will now appear that regular stretcher blocks 90 are like stretcher blocks 14 and 15, but in which the top longitudinal ribs 93 and 94 are continuous and not shortened as is rib 43 on block 14 or rib 79 on block 15.

The several blocks above described are embodied in a wall assembly in the following manner. The bottom course A may begin at corner block 12 seen in FIGS. 3 and 4 and it is located with its elongated exterior face 19 directed to the left and its shorter end face 21 directed to the right. This position will place the end grooves 32 and 33 to the left and the ribs 34 and 35 on the interior face to the right, all as viewed in FIG. 1. A stretcher block 14 of the form seen in FIG. 5 is positioned with its end 40 abutting the interior face 18 of corner block 12 (by placing the FIG. 5 block against the FIG. 4 block) so the grooves 48 and 49 mate with the ribs 34 and 35 on block 12, and with the flat 36A adjacent the body extension 22 but clear of the top rib 27. The stretcher block 14 will be at the right of the corner block 12, and now a stretcher block of the regular form of block 90 in FIG. 11 is placed to the left of and in abutment with the end face 20 on block 12 so the grooves 32 and 33 receive the ribs 97 and 98. The wall run outwardly from stretcher blocks 14 and 90 is made up of blocks 90 until another corner or window or door opening is reached.

When corner block 12 of FIG. 4 and stretcher block 14 of FIG. 5 are joined at faces 18 and 40, ribs 23 and 42 line up along the exterior end 21 and 39. That places rib 24 on block 12 and ribs 43 on block 14 out of line as is necessary so that when the overlying corner block 13 of FIG. 8 is put into position the bottom groove 67 will engage the aligned ribs 23 and 42, and the groove 68 will engage the rib 24 and part of the length of groove 68 will extend over the top of block 14 between ribs 42 and 43. At the same time block 13 is put into place the short groove 69 under the body extension 58 will engage the rib 43 adjacent the clear area 36A (FIG. 5). In this manner corner block 13 has its three bottom grooves 67, 68 and 69 mating with four ribs which are ribs 23, and 24 on block 12 (FIG. 4) and ribs 42 and 43 on block 14 (FIG. 5). By reason of this multiple mating of three grooves with four ribs, the corner layup are greatly strengthened so that it is not always necessary to fill the vertically aligned cored opening with grout, which is a step in the wall layup to add strength at the corners. Another important feature of the present corner blocks, like 12 and 13, is that (as seen in FIG. 1) corner block 13 is interlocked with six other blocks which are indicated at 12 and 14 below it, 15 and 90 at the interior face and end face, and 12 and 14 above it. Each corner block is interlocked in this manner.

The next upper course B is made up of blocks which must match the several ribs of the blocks in course A. Thus the corner block 13 of FIGS. 7 and 8 is placed over the corner block 12 of FIGS. 3 and 4 with its bottom longitudinal grooves 67 an 68 mating with ribs 23 and 24 of block 12. This locates the longitudinal external face 55 of block 13 in a running bond over the end face 21 of block 12 and also over half of the longitudinal exterior face 39 of the adjacent stretcher block 14 of FIG. 5. The placement of block 13 in this manner also mates the bottom groove 69 of the body extension 58 over the rib 43 of stretcher block 14 of FIG. 5. The interior face 54 of block 13 is exposed so as to mate with the stretcher block 15 of the form shown in FIG. 9, whereby the grooves 70 and 71 in this face 54 mate with the projecting ribs 82 and 83 on the end face 76 of the block 76. Additionally, the bottom grooves 86 and 87 in the stretcher block 15 mate with the ribs 26 and 27 on the upper face 16 of the corner block 12. It is noted that the flat 72A on the stretcher block 15 is positioned so as to clear the rib 63 on the body extension 58 on the corner block 13. The wall runs outwardly from the corner of course B is made up of regular stretcher blocks 90, with the ends ribs and grooves suitably oriented to mate with the stretcher blocks 14 and 15.

Subsequent courses C, D and E are made up in accordance with the foregoing description relating to course A and B. This will mean that course C is identical with course A and course D is identical with course B. The wall is laid up in this fashion with alternate courses so that running bonds are established between all blocks.

In the view of FIG. 1 there is seen a door opening which is formed by stretcher block 101 with flat ends, and blocks 102 which are approximately one-half length of blocks 101. These blocks 101 and 102 are grooved at 103 and 104 in the vertical ends. Normally grooves like these are provided for receiving a window frame (not shown). When the courses have reached the proper height, lintel blocks of the type shown at 104 are used to bridge the door opening. These blocks have grooves 105 and 106 in the bottom surfaces which mate with ribs 92 and 94 on the top surface of the underlying courses of stretcher blocks 90. The main body of the lintel blocks 104 are formed with adjacent upwardly opening channels 107 which receive reinforcing rods 108 and mortar so as to form a rigid load carrying beam across openings. Of course, the lintel blocks 104 are formed with ribs so as to make them compatible with the grooves 99 and 100 in the bottom surface of overlying courses of stretcher blocks 90. The foregoing has described very briefly the formation of an opening in a wall made up of the mortarless interlocking masonry blocks of this invention, and it is understood that window openings may be similarly formed by using the special shapes of blocks seen at 101 and 102.

It can now be appreciated that the facets formed on the several ribs which mate with the corresponding facets in the grooves carry loads and also distribute loads so that there will be no load concentration or no high unit loading between ribs and grooves. It is also appreciated from the foregoing description that the ribs and grooves are formed with slanting surfaces so as to form right triangular configurations for the purpose of securing self-alignment and also positive interlock of the blocks in and between courses so that the final wall will not require mortar and will be desirably resistant to lateral loads and have weather barrier properties.

The foregoing description has set forth details of a preferred embodiment of masonry blocks 12, 13, 14, 15 and 90 which are essential to the erection of the mortarless interlocking block wall. In erecting such a wall the key blocks are those at the corners which establish the running bond layup and preserve the interlocking cooperation with all adjacent blocks.

What is claimed is:

1. In a mortarless interlocking block wall assembly made up of multiple courses of stretcher blocks converging into a corner from two directions and interlocking with cooperating corner blocks in each course: the improvement of corner blocks each comprising a generally rectangular body having top and bottom surfaces, interior and exterior faces and opposite ends; a body extension on said interior face adjacent one end face and having top and bottom surfaces matching said first body surfaces; a first pair of ribs, one on said top surface of said body adjacent and parallel to said exterior face and one on said top surface of said body extension parallel to said first one of said ribs; a second pair of ribs on said body top surface in parallel and spaced relation with one of said second pair of ribs being adjacent and parallel to the opposite one of said end faces; three parallel grooves in said corner block, one being in the bottom surface of said body extension and two being in said bottom surface of said body, said grooves being parallel to said first pair of ribs; and separate means on said body interior face and on said one end face, each being adapted to engage and interlock with stretcher blocks.

2. The corner block improvement set forth in claim 1 wherein said rectangular body is formed with a pair of cored out openings extending through said top and bottom surfaces, said first pair of ribs is located on opposite sides of one cored out opening, and said second pair of ribs is located on opposite sides of the other one of the cored out openings.

3. The corner block improvement set forth in claim 1 wherein said separate means on said body interior face is a pair of ribs and on said one end face is a pair of grooves, said last named pair of grooves being aligned with two of said three bottom surface grooves, and one of said last named pair of ribs being aligned with the one of said second pair of ribs adjacent said opposite one of said end faces.

4. The corner block improvement set forth in claim 1 wherein said separate means on said body interior face is a pair of grooves and on said one end face is a pair of ribs, said last named pair of ribs being aligned with one of said pair of ribs on said top surface, and one of said last named pair of grooves being aligned with the one of said second pair of ribs adjacent said opposite one of said end faces.

5. In mortarless interlocking stackable blocks the combination of: first and second elongated and corner forming blocks having a body and body extension of uniform heighth providing co-extensive top and bottom surfaces, opposite elongated sides and opposite ends with one end and one side including said body extension, each of said corner blocks having three spaced apart and elongated grooves in said bottom surface and two pairs of ribs in said top surface with one pair being perpendicular to the other pair; said first corner block having a pair of grooves in said one end which includes said body extension and a pair of ribs in said one side which includes said body extension; said second corner block having a pair of ribs in said one end which includes said body extension and a pair of grooves in said one side which includes said body extension; and stretcher blocks having elongated bodies of uniform heighth matching said corner block heighth, said stretcher blocks having elongated grooves in the bottom and one end and elongated ribs in the top and the opposite end; said stretcher block end ribs interlocking selectively with said grooves in said one end of said first corner blocks and with said grooves in one side of said second corner blocks, and said corner blocks being stackable with certain of said bottom grooves interlocking with a rib in the top surface of an underlying corner block and in a rib on the top of an adjacent stretcher block.

6. A mortarless interlocking building block wall formed of blocks of generally rectangular shape superposed in courses in which the blocks in one course overlap and form running bonds with the blocks in adjacent courses, said wall containing stretcher blocks and corner blocks with said stretcher blocks converging upon said corner blocks, said corner blocks in alternate courses having generally parallel top and bottom surfaces, generally parallel exterior and interior faces and opposite end faces generally perpendicular to said top and bottom surfaces and exterior and interior faces, said bottom surfaces having a pair of grooves therein and said top surface having a plurality of projecting ribs, said bodies of said corner blocks having an extension on said interior face adjacent one end face, said extensions being formed with a rib adjacent said body top surface and a groove adjacent said body bottom surface, and all of said grooves and ribs having matching vertical and sloping surfaces and load bearing facets between said vertical and sloping surfaces.

7. The building block wall set forth in claim 6 wherein said corner blocks comprise: first corner blocks having said end faces of unequal dimension with a pair of spaced ribs on one of said unequal ends and said pair of ribs being in alignment with certain of said top surface ribs; and second corner blocks having said end faces of unequal dimension with a pair of grooves therein being in aligment with certain of said grooves in said bottom surface.

8. The masonry building wall block set forth in claim 6 wherein said corner blocks comprise: first corner blocks having said interior face adjacent said extension formed with grooves therein; second corner blocks having said interior face adjacent said extension formed with ribs thereon; and said stretcher blocks having end faces with ribs on one end and grooves in the opposite end, said stretcher block end ribs mating with said grooves in said first corner blocks and said stretcher block grooves mating with said ribs in said second corner block.

9. The masonry building block wall set forth in claim 6 wherein said corner blocks have a width across one end face between said exterior face and said body extension which is one and one-half times the width across the opposite end face, and said interior face between said body extension and said opposite end face has a length which is two-thirds the length of said elongated exterior face.

10. The masonry building block wall set forth in claim 9 wherein said stretcher blocks have a width approximately two-thirds the length thereof such that the width substantially matches the wider one of said corner block end faces.

11. In a building wall made up of self-aligning and interlocking blocks, the combination of the corner blocks providing rectangular bodies with an interior vertical face having a portion of its length between opposite transverse end faces taken up by an outward body extension thereon at one end face such that the remaining length of said interior face from said body extension to the opposite end is substantially the same as the transverse dimension of said one end including said body extension, certain of said corner blocks having a pair of vertically directed ribs on said interior face spaced apart by the remaining length thereof and a pair of vertically directed grooves spaced apart on said one end by the transverse dimension thereof, certain other of said corner blocks having a pair of vertical directed grooves on said interior face spaced apart by the remaining length thereof and a pair of vertically directed ribs spaced apart on said one end by the transverse dimension thereof; stretcher blocks having rectangular bodies with opposite transverse end faces and a body between said end face of uniform width substantially equal to said remaining length of said interior face of said corner blocks, there being vertically directed spaced apart ribs on one end face and vertically directed spaced apart grooves on the opposite end face with said ribs and grooves shaped to align and interlock with corresponding grooves and ribs of said corner blocks; and said corner blocks and stretcher blocks having a plurality of spaced ribs on the upwardly presented surfaces thereof which align and interlock with a plurality of spaced grooves on the downwardly presented surfaces of others of said corner and stretcher blocks.

* * * * *